US010658164B2

(12) United States Patent
Davidson et al.

(10) Patent No.: US 10,658,164 B2
(45) Date of Patent: May 19, 2020

(54) THERMIONIC ENERGY CONVERSION WITH RESUPPLY OF HYDROGEN

(71) Applicants: Jimmy L Davidson, Brentwood, TN (US); David V Kerns, Jr., Monteagle, TN (US)

(72) Inventors: Jimmy L Davidson, Brentwood, TN (US); David V Kerns, Jr., Monteagle, TN (US)

( * ) Notice: Subject to any disclaimer, the term of this patent is extended or adjusted under 35 U.S.C. 154(b) by 24 days.

(21) Appl. No.: 15/881,773

(22) Filed: Jan. 28, 2018

(65) Prior Publication Data

US 2019/0237313 A1 Aug. 1, 2019

(51) Int. Cl.
*H01J 45/00* (2006.01)

(52) U.S. Cl.
CPC ..... *H01J 45/00* (2013.01)

(58) Field of Classification Search
CPC ..... H01J 45/00
USPC ..... 310/306
See application file for complete search history.

(56) References Cited

U.S. PATENT DOCUMENTS 7,109,408 B2 * 9/2006 Kucherov ..... H01L 29/08 136/201
2011/0148248 A1 * 6/2011 Landa ..... H01J 45/00 310/306
2011/0221328 A1 * 9/2011 Nemanich ..... H01J 1/14 313/355
2013/0221843 A1 * 8/2013 Cheatham, III ..... H01J 29/02 315/14
2014/0333213 A1 * 11/2014 Cheatham, III ..... H01J 29/02 315/167
2015/0075579 A1 * 3/2015 Kataoka ..... H01J 45/00 136/205

* cited by examiner

*Primary Examiner* — Terrance L Kenerly
(74) *Attorney, Agent, or Firm* — Patterson Intellectual Property Law, P.C.; Mark J. Patterson

(57) ABSTRACT

There is a need to produce electric power by means that provide low pollution and high efficiency. Thermionic energy conversion (TEC) systems enable the direct conversion of energy from thermal to electric, based on the emission of electrons from a heated cathode, Diamond is an ideal material for the cathode because of its high temperature mechanical stability, its ability to be created with low resistivity, and its strong tendency to emit electrons. The efficiency of current TEC systems is not practical, as above approximately 700° C. the current produced decreases. The presence of hydrogen at the electron-emitting surface is required to enhance thermionic emission. The present invention provides a resupply of hydrogen to the emitting surface by diffusion of hydrogen through the diamond cathode, and enables efficient operation of TEC systems at temperatures well above the current limit; practical systems for direct conversion of heat to electricity are thus enabled.

14 Claims, 6 Drawing Sheets

THERMIONIC ENERGY CONVERSION WITH RESUPPLY OF HYDROGEN

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Some references, which may include patents, patent applications and various publications, may be cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference. Multiple references are not specifically referenced in the specification and are included for completeness.

In terms of notation, hereinafter, "[n]" represents the nth reference cited in the reference list. For example, [4] represents the 4th reference cited in the reference list, namely, J. H. Ingold, "Calculation of the Maximum Efficiency of the Thermionic Converter," Journal of Applied Physics, vol. 32, pp. 769-772, 1961.

STATEMENT REGARDING FEDERALLY SPONSORED RESEARCH OR DEVELOPMENT

None; Not Applicable

REFERENCE TO SEQUENCE LISTING OR COMPUTER PROGRAM LISTING APPENDIX

Not Applicable

BACKGROUND OF THE INVENTION

There is a pressing need to more efficiently produce electric power from alternative sources and methods. While carbon based fuels have dominated energy generation in the past, there is growing interest in sources and methods that provide less pollution and higher efficiency. The direct conversion of heat into electric current flow, if made efficient and practical, opens the possibility of a wide range of heat sources to drive a Thermionic Energy Conversion (TEC) system, from conventional fuels, to solar concentrators, to geothermal or any other heat source, including reclaimed heat.

Thermionic energy conversion (TEC) is a technique that allows for the efficient conversion of thermal energy directly into electrical energy [1-6]. TEC is based on the widely understood physical principal of thermionic emission which describes the thermal emission of electrons from a heated cathode, relative so the anode, as shown in FIG. 1. As a cathode is heated above zero Kelvin, it can be predicted, based on Fermi-Dirac statistics that some of the cathode's electrons will have energies equal to or greater than the cathode's work function. The work function is the energy required for an electron to be emitted into a vacuum. This process can be described by the Richardson Equation (Equation 1) [7-8].

$$J=AT^2e^{(-\Phi/kT)} \tag{1}$$

Where: J=Current Density (A/cm2); A=Richardson Constant (A/K2 cm2); T=Temperature (K); Φ=work function (eV); and k=Boltzmann constant (eV/K). It follows from the Richardson equation that high thermionic emission current densities can be achieved by a material with a high Richardson constant and a low work function.

A thermionic energy conversion (TEC) system comprises a cathode, an anode, a controlled environment between the two, and the necessary electrical connections to enable the current generated to flow in an external circuit. In a basic thermionic converter, the cathode and anode are separated by a gap which is generally in a vacuum and which enables electrons to cross without intercepting (i.e. colliding with) gas molecules or ions. There exists prior art that incorporates gaseous species into this gap at relatively low concentrations to enhance electron emission from the cathode. As thermal energy is imparted to the cathode, electrons with sufficient energy will emit thermionically from the surface and traverse the vacuum gap where they collect at the anode. The electrons then provide energy to an electrical load as they are cycled back to the cathode through an electrical circuit between anode and cathode.

The prior art suggests that diamond is an ideal material for the cathode in a TEC system. Diamond has unique properties that make it especially suited for this purpose [9].

Diamond has a wide band gap, 5.5 eV and, when doped, will become electrically conductive, and its conductivity will increase at elevated temperatures. In one embodiment, doped diamond polycrystalline film is grown in an environment with boron; in another embodiment it is grown with nitrogen. Establishing a low resistance path for electrical current utilizing such doped diamond material is detailed in the prior art, and has been demonstrated [10].

Diamond material maintains its physical integrity at very high temperatures (e.g. up to the range of 1000-1200 degrees C.) because of the strength of the carbon sp3 bonding and has the ability to withstand repetitive cycling from an ambient of approximately room temperature to high (e.g. 1000 degrees C.), as well as low (negative 100 degrees C.) temperatures. The compactness of the atomic structure prevents typical doping ions (e.g. boron) from out-gassing (out-diffusing), or decreasing in concentration at high temperatures. An additional advantage of the robustness of the diamond crystal lattice is its virtual immunity to radiation damage and other forms of environmental stress [11].

Importantly, diamond or certain material containing diamond has a very low work-function and low electron affinity, which makes the emission of electrons from said diamond surface more efficient than with most other materials [12].

In addition, diamond has the highest thermal conductivity of any known material, approximately five times that of copper, and therefore the design of systems in which heat is readily conducted to the electron-emitting surface, or extracted from the anode, is simplified and made more efficient [13].

Chemical Vapor Deposited (CVD) polycrystalline diamond has nearly all of the superior material properties of single crystal diamond without the high cost. In addition, it can be patterned and deposited and doped into a semiconductor, and processed with many known silicon semiconductor processing methods. Diamond and such diamond films can be made substantially conductive by incorporating nitrogen, boron or other dopant materials in its growth.

Diamond has the rare combination of material properties of extremely high thermal conductivity and the control of electrical conductivity: i.e. can be fabricated with known methods by addition of other materials in small concentrations (doping), resulting in a polycrystalline diamond film with high electrical conductivity.

Therefore, it first appears that diamond would make an ideal electron emitter in TEC systems, following the Richardson equation to very high temperatures; in practice, diamond cathode emitters have a limitation. Such emitters have consistently shown enhanced emission to approximately 600-800 degrees Centigrade, at which point electron emission begins to diminish, and as temperature is further increased, electron emission decreases approaching zero.

Recent prior art [1] suggests the introduction of certain gas species, such as hydrogen (or gas molecules containing hydrogen), into the vacuum chamber between the cathode and anode have demonstrated increases in emission current. The concentration of gas that can be introduced into the gap is limited by the fact that if too high, a substantial percentage of electrons crossing from cathode to anode will suffer a collision with a gas molecule or ion, and will fail to transport. The previously mentioned reference [1] discloses the introduction of hydrogen-containing gas species into the gap while maintaining a vacuum at or below 5.5×10−6 Torr, which remains a relatively low concentration of hydrogen in said gap.

It has been reported that the exposure of diamond cathodes to a low energy hydrogen plasma enhances the thermionic emission current from diamond films [14]. This enhancement is reviewed and extensively described in Reference [1]. That is, it has been documented by multiple sources, as is further summarized in Reference [1], that a diamond layer heated in a partial pressure of hydrogen (or certain hydrogen bearing gaseous species) will emit electrons somewhat more efficiently under certain conditions, but there is no prior art demonstrating the potential to significantly increase the electric current emitted to an anode to a substantially higher value than that of a pure vacuum, thereby providing a practical level of electric power generation. [1, 9-14] Thus, trying to provide an atmosphere with a partial pressure of hydrogen in the gap between cathode and anode, exposing the diamond cathode emitter surface will not prolong or preserve emission at higher temperatures, i.e., at high temperature (e.g. above about 600-800 degrees Centigrade) because the hydrogen or hydrogen ions cannot reside on the diamond surface to provide the electron escape enhancement.

The method of reference [1] has only demonstrated improvement in electron emission and related efficiency in the range of 10 percent or less. Thus, a significant innovation is required in order to achieve increased current density at temperatures well above the range of 600-800 degrees Centigrade and extending to above 1000 degrees Centigrade. This is the subject of the present invention.

In order to more quantitatively define the above limitation, we refer to the Richardson equation (Equation 1) which describes the ideal performance of thermionic electron emission. As shown in FIG. 2, the solid curve is a plot of the Richardson equation for a diamond emitter, and projects a current increasing super-linearly with temperature, reaching significant currents at high temperatures. Extrapolation of this curve to temperatures in the range of 900-1100 degrees Centigrade predicts unprecedented current production per unit area. The present reality is that shown with the dots in FIG. 2, in which the current peaks at a temperature in the range of 600 to 800 degrees Centigrade, and then decreases. The method of introducing a partial pressure of hydrogen or hydrogen ions, or hydrogen containing compounds into the said gap results in only a modest improvement in electron emission.

If this limitation of TEC efficiency at temperatures above 700 degrees Centigrade could be overcome, then this technology can approach total energy conversion efficiencies of 90% of the Carnot limit, which is a vast improvement over current technologies. This invention addresses eliminating the previously mentioned limitation and enables TEC devices to perform at significantly higher temperatures and with a corresponding improvement in current output per unit area of emission. This invention enables the practical direct thermal generation of electrical power with the TEC approach. [1-5]

BRIEF SUMMARY OF THE INVENTION

The present invention makes practical the direct conversion of heat into electric current by utilizing diamond, CVD (chemical vapor deposition) deposited polycrystalline diamond films, PECVD (plasma-enhanced chemical vapor deposition) diamond films, or diamond like material as the cathode in a Thermionic Energy Conversion (TEC) system in a novel configuration, in which hydrogen is continuously resupplied to the cathode electron-emitting surface. The hydrogen, hydrogen ions or compounds containing hydrogen are supplied by diffusion through the cathode from a source at a surface of said diamond that is external to the vessel containing the anode and the electron-emitting surface of the cathode, and diffuse to the electron-emitting surface. This invention enables increasingly efficient operation of the TEC system at temperatures well above the current prior art limit of approximately 700 degrees Centigrade.

DETAILED DESCRIPTION OF THE INVENTION

Figure 1:
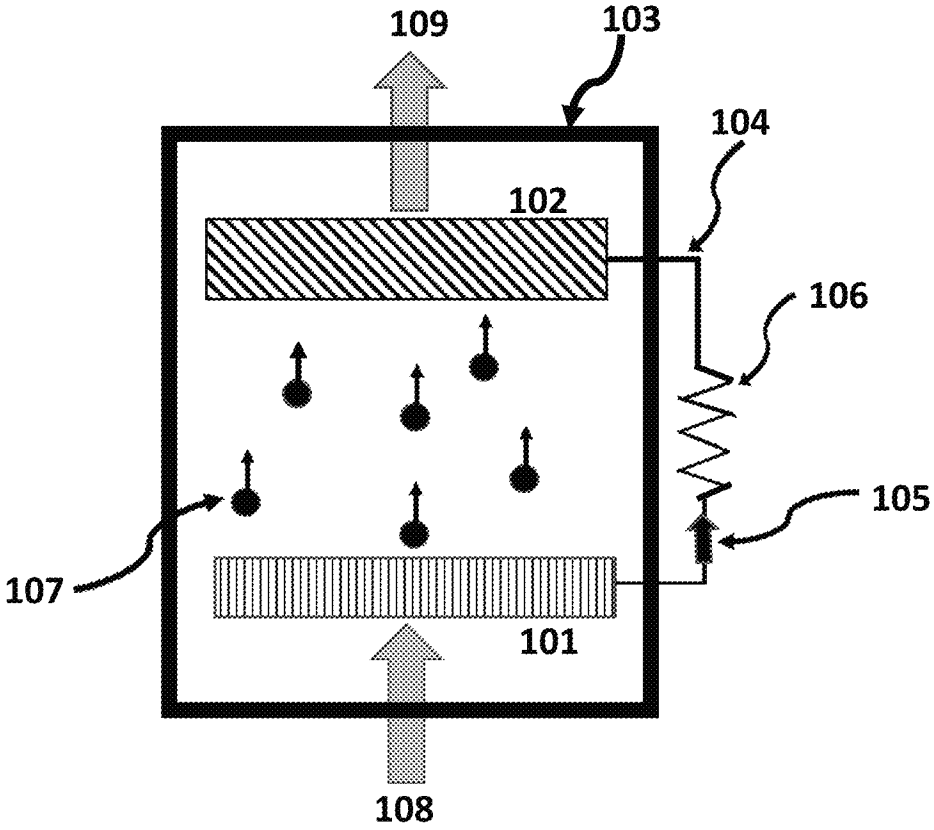
FIG. 1. Basic Mechanism of Thermionic Emission Conversion (TEC) System to convert Heat into Electric Current.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art.

The terms used in this specification generally have their ordinary meetings in the art, within the context of the invention, and in the specific context where each term is used. Certain terms that are used to describe the invention are discussed below, or elsewhere in this specification, to provide additional guidance to the practitioner regarding description of the invention. For convenience, certain terms may be highlighted, for example using italics and/or quotation marks. The use of highlighting has no influence on scope and meaning of a term; the scope and meaning of a term is the same, in the same context, whether or not it is highlighted. It will be appreciated that the same thing can be said more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element, or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section discussed below and could be termed a second element, component, region, layer or section without departing from the teachings of the invention.

The terminology used herein is for the purpose of describing particular embodiments only and is not intended to be limiting of the invention. As used herein, the singular forms of "a", "an", and "the" are intended to include the plural forms as well, unless the context clearly dictates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof Furthermore, relative terms such as "lower" or "bottom" and "upper" or "top" may be used herein to describe one element's relationship to another element as illustrated in the figures. It will be understood that relative terms are intended to encompass different orientations of the device in addition to the orientation depicted in the figures. For example, if the devices in one of the figures is turned over, elements described as being on the "lower" said of other elements would be oriented on "upper" sides of the other elements. The exemplary term "lower", can therefore, encompass both an orientation of "lower" and "upper" depending on the particular orientation of the figure. Similarly, if the device in one of the figures is turned over, elements described as "below" or "beneath" other elements within the oriented "above" the other elements. The exemplary terms "below" "beneath" can, therefore, encompass both an orientation of above and below.

Unless otherwise defined all terms (including technical and scientific terms) used herein have the same meaning as commonly understood by one of ordinary skill in the art to which this invention belongs. It will be further understood that terms, such as those defined in commonly used dictionaries, should be interpreted as having a meeting that is consistent with their meaning the context of the relevant art and the present disclosure, it will not be interpreted as an idealized or overly formal sense unless expressly so defined herein.

It will be understood that when an element is referred to as being "on", "attached" to, "connected" to, "coupled" with, "contacting", etc., another element, it can be directly on, attached to, connected to, coupled with or contacting the other element, or intervening elements may also be present. In contrast, when an element is referred to as, for example, "directly on", "directly attached" to, "directly connected" to, "directly coupled" with or "directly contacting" another element, there are no intervening elements present. It will also be appreciated by those skilled in the art that references to a structure or feature that is disposed "adjacent" another feature may have portions that overlap or underlie the adjacent feature.

As used herein, "around", "about", "substantially". "range" or "approximately" shall generally mean within 20% preferably within 10%, and more preferably within 5% of given value our range. Numerical quantities given herein are approximate, being at the term "around", "about", "substantially" or "approximately" can be inferred if not expressly stated.

The description will be made as to the embodiments of the invention in conjunction with the accompanying drawings. In accordance with the purposes of this invention, as embodied and broadly described herein, this invention in one aspect, relates to an enhanced thermionic energy converter and applications of the same.

Any reference to diamond in this document includes single-crystal diamond, CVD-deposited diamond films (both single crystal and polycrystalline), diamond-like materials and any other materials in which there is substantial presence of the carbon-carbon tetrahedral bonding structure characteristic of diamond. Other cathode materials with a low work-function, such as Cesium, which is fabricated in a manner that enables hydrogen transport, such as a thin porous film or such a film supported by another element, are also included as materials for said cathode. Herein, hydrogen, hydrogen ions, or a gaseous species containing hydrogen may be designated as H, for convenience of reference.

A thermionic energy conversion (TEC) system, as shown in FIG. 1, comprises at least the following elements: a cathode (101), an anode (102) separated from the cathode by a gap, a containment vessel (103) for enabling confinement and control of the environment of the gap between the cathode and anode, and the necessary electrical connections (104) between the cathode and anode to enable an electric circuit for providing electric current (105) to an electrical load (106) external to the containment vessel. The environment between cathode and anode must be sufficiently void of gas molecules to allow the free flow of electrons (107) without substantial collisions. Further there must be means for providing heat or transferring thermal energy, heat, (108) to the cathode and means (109) for extracting heat or transferring thermal energy (109) from the anode.

In a basic thermionic converter, the cathode and anode are separated by an environment which is generally a vacuum of approximately $10^{-6}$ Torr or less, and which enables electrons to cross without intercepting or colliding with gas molecules. In recent prior art, [1], certain gas species such as hydrogen or hydrogen compounds are introduced into the gap to enhance thermionic emission from the cathode.

Figure 3:
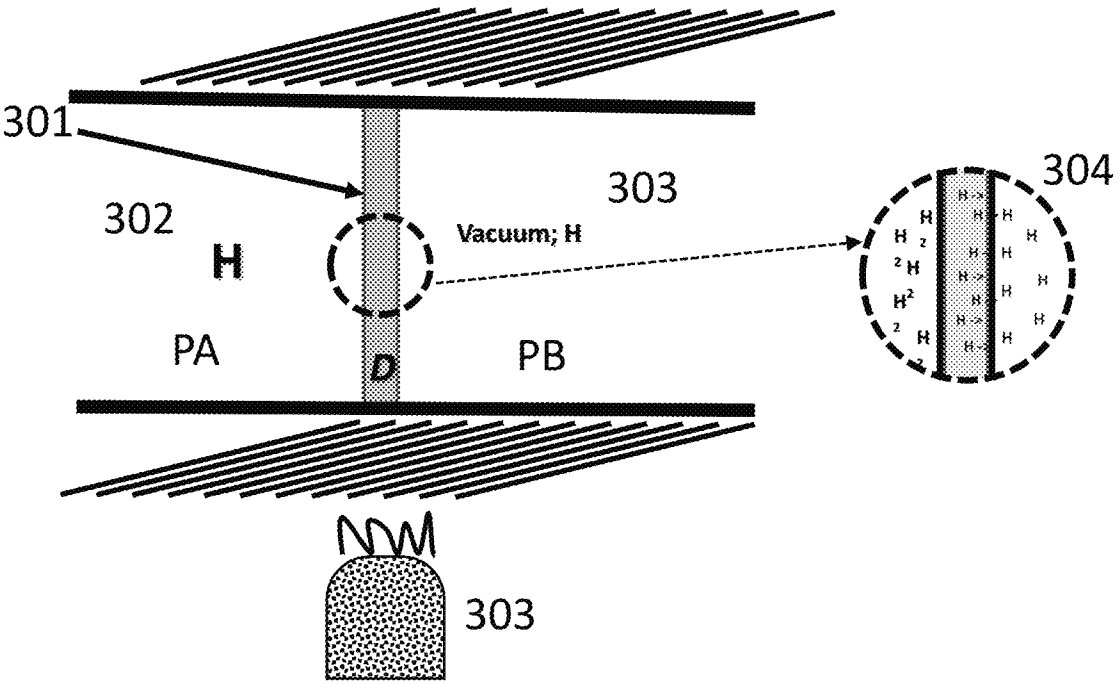
FIG. 3. Side-View of Section of the Electron-Emitting Diamond or Diamond Film Cathode and Regions on Either Side.

The novelty of the present invention is illustrated in FIG. 3 in which the hydrogen or hydrogen ions are supplied by a source external to the vessel containing the anode and the electron-emitting surface of the cathode. Hydrogen species diffuse according to Fick's Law of Diffusion, through the cathode, providing a continuous resupply of said hydrogen species at the electron-emitting surface.

In order to further demonstrate the novelty of the present invention it is useful to describe the mechanism which currently limits the prior art to achieve an increase in current at limited cathode temperatures, and relates directly to the novelty and utility of the present invention.

Hydrogen has been shown to greatly enhance the electrical properties of diamond by increasing its conductivity and inducing a significant enhancement of negative electron affinity, both of which are favorable for thermionic emission [1; 14-18]. The practical implementation of TEC cathodes has been hindered by the relatively low temperature ceiling at which such cathodes effectively emit electrons. As previously noted herein, the emission current from diamond-based cathodes begins to decrease at temperatures exceeding approximately 600-800 degrees Centigrade. This deviation from the Richardson equation has been attributed significantly to the desorption of hydrogen from the diamond surface. There have been recent studies directed toward better understanding the role of hydrogen in the thermionic emission behavior of diamond cathodes [1-9, 18-21].

As described in reference [1], the diamond electron emission as a function of temperature is explained by a quantum phenomenon involving the residence of hydrogen at or near the diamond surface. Thermal energy causes electrons in the diamond to escape, move to the anode and result in electric current. The presence of hydrogen in this conversion of heat energy to electron energy is essential, as argued clearly in reference [1] in which, up to a certain temperature, the greater the thermal energy supplied, (the higher the temperature) the more electrons are emitted, and the current increase is exponential as expected.

Figure 2:
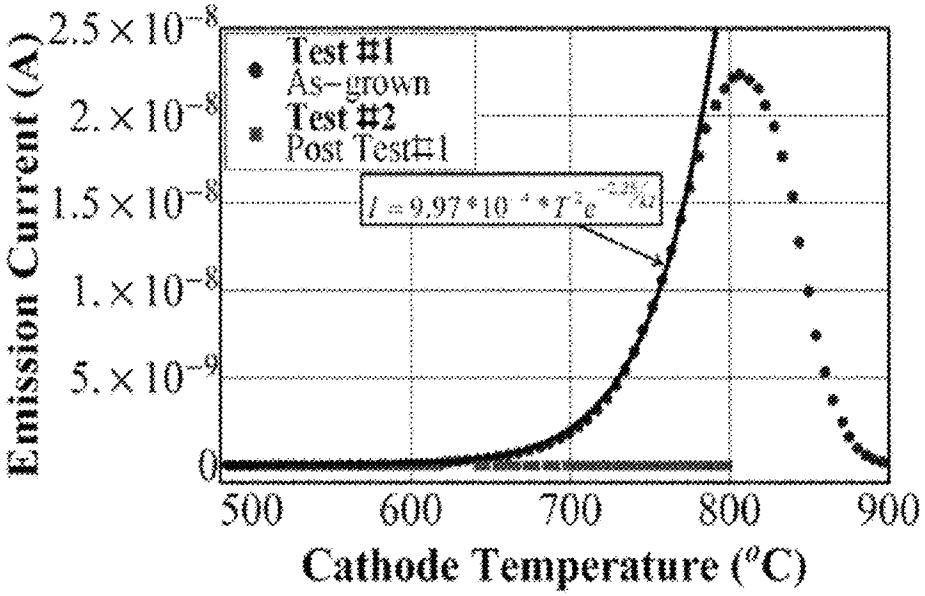
FIG. 2. Plot of Emission Current for Ideal Richardson Equation (solid line with equation) and Actual Data of Emission Current from TEC Device (Dots) with Deviation from Richardson Curve Beginning About 775 Degrees Centigrade and the Rapid Peak and Decline of Emission Current with Further Temperature Increase [1].

However, there are competing phenomena; namely, as the temperature rises, the hydrogen present in or on the diamond is affected. At least two significant results occur as temperature is increased:

1. The hydrogen or hydrogen ions, (H), initially present in the diamond tends to diffuse (that is, move about in the diamond lattice) and, per Fick's Law, it will migrate towards regions of lower concentration and that is the free (electron-emitting) surface of the diamond. This results in a "time-dependent" response shown as Test 2 in FIG. 2 in which minimal current is produced in a subsequent (second) test of the same TEC system [1].

2. The hydrogen or hydrogen ions (H), at the surface will have higher energy as the temperature increases and will reach a point where it jumps or departs from the surface. Thus, a mechanism arises whereby the concentration of H in the diamond starts to decrease at the electron-emitting surface. Current flow can be maintained only temporarily because the H diffusing from the interior of the diamond to the surface is temporarily replenishing the H that is leaving the surface; however, after sufficient time at a higher temperature, the H concentration becomes depleted and the H enhancement of the thermally stimulated electron diminishes and disappears.

As previously noted, prior art at attempts to resupply the said H at the emitting surface by increasing the partial pressure of same in the gap have resulted in very modest improvement in performance; this limitation has been described earlier in the appropriate section. The present invention provides a novel approach to providing a continuous resupply of H available to the electron-emitting surface and enables significant performance enhancement.

Thus the electron emitter continues to emit and follow the Richardson equation at temperatures up to the range of 800 to 1100 degrees centigrade or higher, and the current densities reach over 0.5 to 10 amperes/$cm^2$. This invention therefore provides energy conversion performance exceeding present EM (Maxwellian electromagnetic) and PV (photovoltaic, e.g., "solar cells") techniques.

At high temperatures hydrogen will diffuse in diamond. Hydrogen is the only element small enough to easily diffuse through the closely packed diamond lattice. Therefore, as illustrated in FIG. 3, H can be made to migrate through diamond (301) from one side of a region of H presence (302) to the other side (303) of a diamond film, membrane or window where there is a less or minimal H presence. The flow of H from the region at the back side of the diamond film (Region 301 of FIG. 3) to the emitting surface of the diamond and into Region (302) (of FIG. 3) is driven by diffusion; the partial pressure of H in side (302) is higher than that in Region (303), as Fick's law applies. That is, in FIG. 3, which shows a side-view section of one embodiment of a diamond film or membrane, in which the face of said diamond-facing region (303) is utilized as an electron-emitting diamond cathode:

Therefore, in FIG. 3 the following are identified:

Region (302) comprises a region of hydrogen, H, at pressure $P_A$.

Region (303) comprises a region containing little or no hydrogen, H, e.g., substantially a vacuum at pressure $P_B$ where $P_A$ is greater or much greater than $P_B$ Element 301 comprises a diamond film which completely separates region (302) from region (303). Diamond (301) is capable of sustaining large differences in pressure $P_A >> P_B$; the physical integrity of the membrane is possible because of the high mechanical strength of diamond, or by means of a physical structure in which the diamond is supported by attachment to a perforated or porous substrate providing mechanical stability.

Element (304) comprises a heat/thermal source which can be combustion, solar, or any other means of heat generation, and can maintain diamond cathode (301) at temperatures in excess of 1000 degrees Centigrade.

Thus, H is maintained in region (302) at a sufficient pressure $P_A$ such that, at any temperature exceeding approximately 600-800 degrees Centigrade, The H diffusing through the diamond (301) will maintain a concentration of H at the surface of said diamond on the side that faces region (303) to support the enhanced electron emission and extend performance to follow the Richardson curve as described previously.

If desired, the H can be collected from the vacuum system and recycled to the hydrogen input, to minimize the use of H in the process. Electron emission from the "backside" of the diamond emission membrane, the face of said diamond adjacent to region (302), is suppressed by the presence of a relatively high partial pressure (non-vacuum) of H ($P_A$); in another embodiment, additionally, the surface topology of the faces can be utilized to enhance or suppress electron emission. A rougher surface has a plurality of sharper peaks, which enhance the local electric field, therefore stimulating an increase in electron emission (utilized on the face disposed to (303). Conversely, a smoother surface suppresses electron emission. and a topology less conducive (smoother) to emission can be utilized on the face adjacent to (302).

In yet another embodiment, there is the utilization of an electric field by applying a voltage bias on the anode, and/or on other electrodes in the Region (303), as described by prior art, to direct the flow of electrons to the anode [23].

In this latter embodiment, one or more accelerating electrodes (a mesh or perforated structure i.e., grid) biased positively with respect to the cathode, can be used to accelerate emitted electrons toward the anode. In addition, electrodes in region (303) with appropriate bias also can serve to minimize a space-charge build-up of negative charge in the gap, due to the finite time required for electrons to transit the gap. This facilitates electron flow at higher electron fluxes (currents). Such electrode configurations and function are familiar to those skilled in the art of electronic vacuum tube operation, in particular pentodes, or the design of same.

Figure 4:
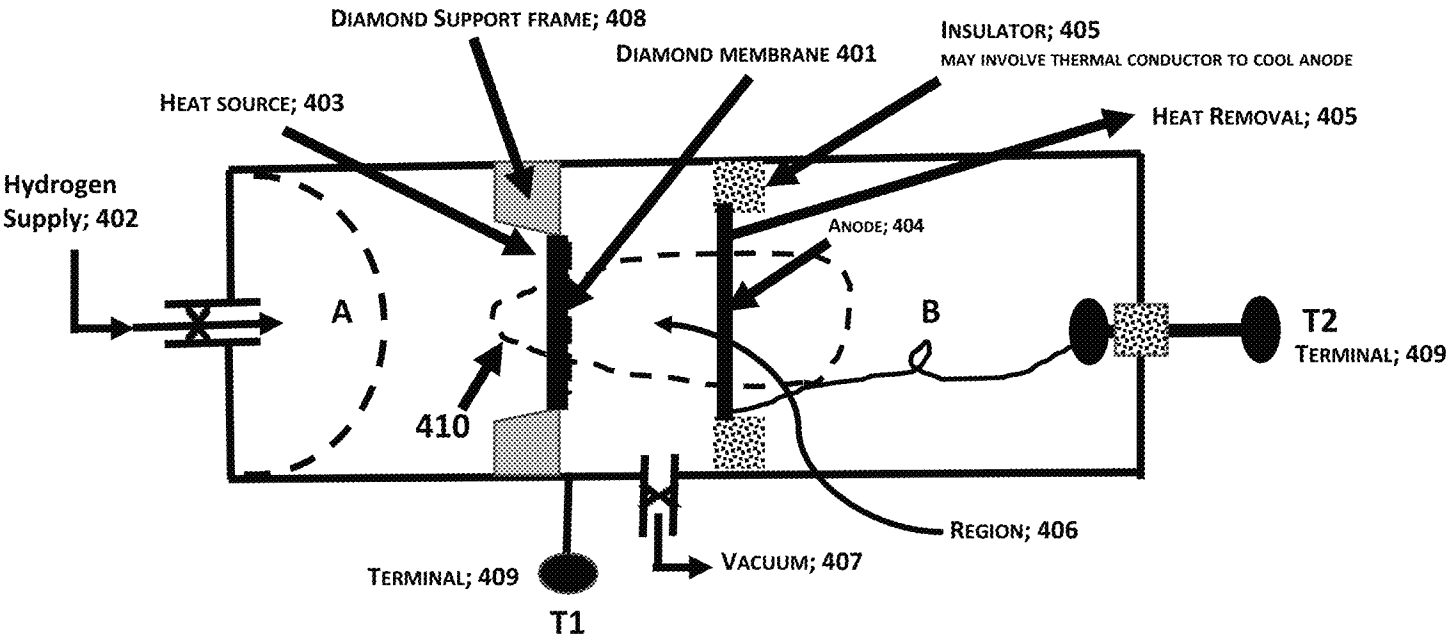
FIG. 4. Cross-Section of TEC System Showing Diamond or Diamond Film Cathode with Hydrogen Back-Supply, Conducting Anode, Means for Heating said Cathode, Cooling said Anode and a Gap In-Between which is Substantially a Vacuum.

One embodiment of a complete, TEC power generating system is illustrated in cross-section in FIG. 4. The drawing shows a TEC system comprising a diamond cathode (401) with a hydrogen (H) or other gas species containing hydrogen resupply source (402) on the back side (not electron-emitting side) of said cathode. Further there is a means (403) for heating said cathode. An electrically conducting anode (404) with provision for cooling anode (heat removal, (405)) and substantially a vacuum gap (406) in between said cathode and anode. Said gap is held substantially at a vacuum by means of a vacuum pump connected to said vessel as shown at (407). A means for mounting (408) of said cathode may be employed and such means may also be utilized to assist in heat removal. This drawing (FIG. 4) shows certain key elements in the volume of the TEC environment controlled vessel or chamber, said vessel or chamber being of cylindrical, rectangular or any other appropriately shaped geometry, providing a volume for containing said electron-emitting surface of the cathode and the electron-receiving surface of the anode in the chamber. In operation, an external circuit comprising the electrical load is connected from terminals T1 to T2 (409) to provide a path for current flow.

Figure 5:
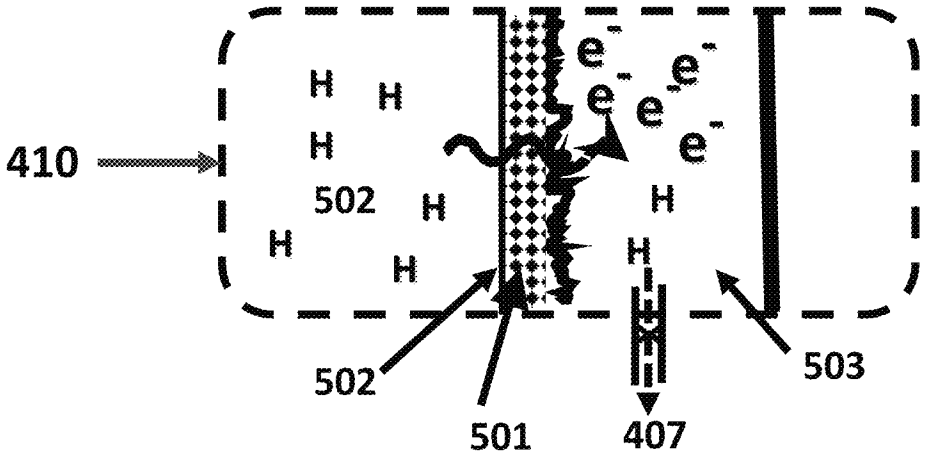
FIG. 5. Close-Up Cross Section of Region 410 from FIG. 4.

FIG. 5 shows a close-up cross-section of region (410) from FIG. 4. A diamond film or membrane (501) is heated to well over 700 degrees Centigrade and emits electrons preferentially by H-enhanced thermal stimulation. The H, if exposed to the cathode from the environment of the gap, would not reside on the diamond surface due to the thermal energy at the cathode surface. Instead, in the present invention, H is replenished to the diamond surface by continually or intermittently diffusing from a resupply source of H from a non-electron-emitting side (502) of the diamond cathode. Current flow as a result of electron thermal emission of greater than 0.5-10 amps/cm$^2$ occurs, and can be maintained because the H enhancement is maintained at temperatures well in excess of 700 degrees Centigrade.

In another embodiment of the present invention, the cathode is comprised of doped diamond which is an electrically conductive membrane of a circular or other convenient geometry, designed with a thickness sufficiently thick to withstand the pressure differential between sides (502) and (503), and yet sufficiently thin to readily allow the diffusion of hydrogen through the membrane from side (502) to side (503). In some embodiments, the diamond membrane (401) has a thickness of less than 200 micrometers. In other embodiments, the diamond membrane will have a thickness of less than 20 micrometers. In yet other embodiments, the diamond membrane will have a thickness of less than 1 micrometer.

Figure 6:
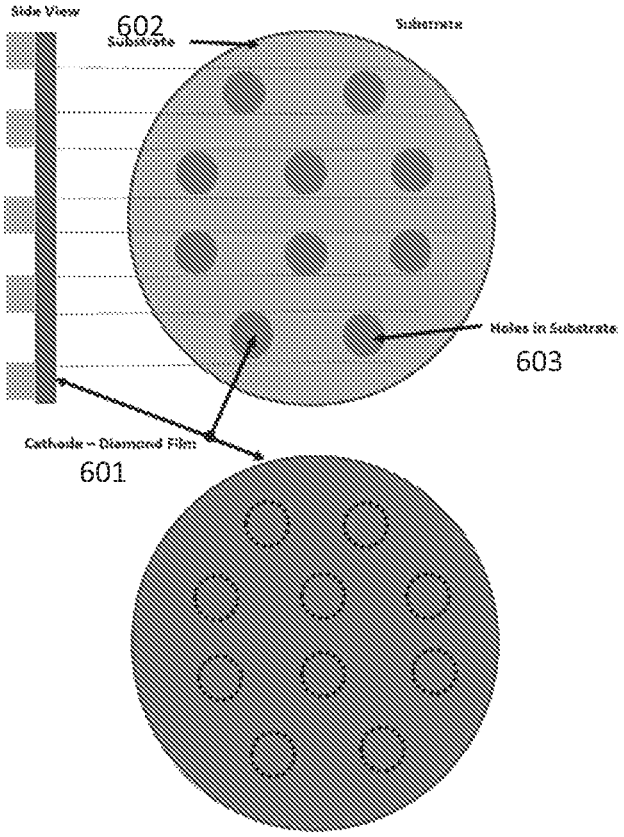
FIG. 6. A Diamond or Diamond Film Cathode on a Mechanical Supporting Substrate with Holes in said support to Provide a Path for Hydrogen Flow to the Emitting Surface.

In yet another embodiment, shown in FIG. 6, the electron-emitting diamond membrane (601) is deposited on a mechanically supporting substrate (602) with openings or holes in said substrate (603). The diamond film for this embodiment can be made thinner, thus allowing a greater flow (diffusion rate) of hydrogen, H, because said perforated substrate (substrate with openings) provides greater mechanical strength for the diamond membrane elements of the smaller holes also achieving the capability of withstanding a greater pressure differential across the membrane. Said holes can be of any size, ranging from centimeters to microns or smaller. In the latter case, this would include a continuous supporting substrate which is substantially permeable to the flow of hydrogen, H.

Another embodiment may include an annular or other electrode structure or structures placed in the gap with a voltage bias(es) of such position and magnitude that said electrode can neutralize any charge accumulation that may be present which are interfering with the electron transport across the gap.

In a further embodiment, one or more electrodes may be placed in the gap as grid structures, physically configured as primarily open to the flow of electrons, but with an electrically conducting structure (e.g., grids as normally defined in vacuum tube technology), which have a bias to accelerate electrons from the emitting surface and in a still further embodiment, a structure near the anode to slow the emitted electrons to prevent secondary emission from the anode. Such electrode or electrodes may also be placed and biased to minimize space charge effects, e.g., the accumulation of negative charge due to finite electron transit times, and which suppress electron flow to the anode.

In addition to the previously mentioned references, additional references are provided to supply documentation of the prior art, and the limitations of the prior art previously described. These limitations are addressed in the current invention.

LISTING OF REFERENCES

[1] Paxton et. al, United States patent application Publication, "Enhanced Thermionic Energy Converter and applications of Same", US 2014/0306575 A1, Oct. 16, 2014.

[2] N. S. Rasor, "Thermionic Energy Converter," in Fundamentals Handbook of Electrical and Computer Engineering. vol. II, S. S. L. Chang, Ed., ed New York: John Wiley & Sons, Inc., 1983, pp. 668-679.

[3] J. M. Houston, Theoretical Efficiency of the Thermionic Energy Converter vol. 30: AIP, 1959.

[4] J. H. Ingold, "Calculation of the Maximum Efficiency of the Thermionic Converter," Journal of Applied Physics, vol. 32, pp. 769-772, 1961.

[5] V. C. Wilson, "Conversion of Heat to Electricity by Thermionic Emission," Journal of Applied Physics, vol. 30, pp. 475-481, 1959.

[6] N. S. Rasor, "Thermionic energy conversion plasmas," Plasma Science, IEEE Transactions on, vol. 19, pp. 1191-1208, 1991.

[7] O. W. Richardson, "The Electrical Conductivity Imparted to a Vacuum by Hot Conductors," Philosophical Transactions of the Royal Society of London. Series A, Containing Papers of a Mathematical or Physical Character, vol. 201, pp. 497-549, 1903.

[8] W. B. Nottingham, "Thermionic Emission," Massachusetts Institute of Technology, Cambridge, Technical Report 321, Dec. 10 1956.

[9] Franz A Koeck; Robert J. Nemanich, "The state and potential of diamond in efficient direct energy conversion", *Vacuum Nanoelectronics Conference* (*IVNC*), 2016 29*th International*

[10] Chris J. H. Wort, Richard S. Balmer, "Review, Diamond as an electronic material", Materials Today, Volume 11, Issues 1-2, January-February 2008, Pages 22-28

[11] Francis P. Bundy, "The P, T phase and reaction diagram for elemental carbon", Journal of Geophysical Research: Solid Earth, Volume 85, Issue B12, 10 Dec. 1980, Pages 6930-6936

[12] L. Diederich, O. M. Kuttel, P. Aebi, L. Schlapbach, "Electron affinity and work function of differently oriented and doped diamond surfaces determined by photoelectron spectroscopy", Surface Science, 418, issue 1, 219-239, 1998

[13] "Material properties of diamond—Wikipedia" https://en.wikipedia.org/wiki/Material_properties_of_diamond

[14] F. J. Himpsel, J. A. Knapp, J. A. VanVechten, and D. E. Eastman, "Quantum photoyield of diamond (111)—A stable negative-affinity emitter," Physical Review B, vol. 20, pp. 624-627, 1979.

[15] J. B. Cui, J. Ristein, M. Stammler, K. Janischowsky, G. Kleber, and L. Ley, "Hydrogen termination and electron emission from CVD diamond surfaces: a combined secondary electron emission, photoelectron emission microscopy, photoelectron yield, and field emission study," Diamond and Related Materials, vol. 9, pp. 1143-1147, 2000.

[16] S. Albin and L. Watkins, "Current-voltage characteristics of thin film and bulk diamond treated in hydrogen plasma," Electron Device Letters, IEEE, vol. 11, pp. 159-161, 1990.

[17] I. L. Krainsky, V. M. Asnin, G. T. Mearini, and J. A. Dayton, Jr., "Negative-electron-affinity effect on the surface of chemical-vapor-deposited diamond polycrystalline films, " Physical Review B, vol. 53, pp. R7650-R7653, 1996.

[18] W. F. Paxton, M. Howell, W. P. Kang, and J. L. Davidson, "Influence of hydrogen on the thermionic electron emission from nitrogen-incorporated polycrystalline diamond films," Journal of Vacuum Science & Technology B: Microelectronics and Nanometer Structures, vol. 30, p. 021202, 2012.

[19] M. Kataoka, C. Zhu, F. A. M. Koeck, and R. J. Nemanich, "Thermionic electron emission from nitrogen-doped homoepitaxial diamond," Diamond and Related Materials, vol. 19, pp. 110-113, 2010.

[20] M. Suzuki, T. Ono, N. Sakuma, and T. Sakai, "Low-temperature thermionic emission from nitrogen-doped nanocrystalline diamond films on n-type Si grown by MPCVD," Diamond and Related Materials, vol. 18, pp. 1274-1277, 2009.

[21] W. F. Paxton, A. Steigerwald, M. Howell, N. Tolk, W. P. Kang, and J. L. Davidson, "The effect of hydrogen desorption kinetics on thermionic emission from polycrystalline chemical vapor deposited diamond," Applied Physics Letters, vol. 101, p. 243509, 2012.

[22] N. S. Rasor, "Emission physics of the thermionic energy converter," Proceedings of the IEEE, vol. 51, pp. 733-747, 1963.

[23] Meir et. al. "Highly-efficient thermoelectronic conversion of solar energy and heat into electric power", Journal of Renewable and Sustainable Energy, vol 5, 2013

[24] K. G. Hernqvist, "Analysis of the arc mode operation of the cesium vapor thermionic energy converter," Proceedings of the IEEE, vol. 51, pp. 748-754, 1963.

[25] H. L. Witting and E. P. Gyftopoulos, "An Ionization Process in a Low-Energy Cesium Plasma," Journal of Applied Physics, vol. 36, pp. 1328-1337, 1965.

[26] G. N. Hatsopoulos, "Transport effects in cesium thermionic converters," Proceedings of the IEEE, vol. 51, pp. 725-733, 1963.

[27] I. Langmuir and K. H. Kingdon, "THERMIONIC EFFECTS CAUSED BY ALKALI VAPORS IN VACUUM TUBES," Science, vol. 57, pp. 58-60, Jan. 12, 1923 1923.

[28] G. O. Fitzpatrick, E. J. Britt, and B. Moyzhes, "Updated perspective on the potential for thermionic conversion to meet 21st Century energy needs," in Energy Conversion Engineering Conference, 1997. IECEC-97., Proceedings of the 32nd Intersociety, 1997, pp. 1045-1051 vol. 2.

[29] F. Maier, J. Ristein, and L. Ley, "Electron affinity of plasma-hydrogenated and chemically oxidized diamond (100) surfaces," Physical Review B, vol. 64, p. 165411, 2001.

[30] F. A. M. Koeck, R. J. Nemanich, Y. Balasubramaniam, K. Haenen, and J. Sharp, "Enhanced thermionic energy conversion and thermionic emission from doped diamond films through methane exposure," Diamond and Related Materials, vol. 20, pp. 1229-1233, 2011.

[31] O. Heber, R. Golser, H. Gnaser, D. Berkovits, Y. Toker, M. Eritt, M. L. Rappaport, and D. Zajfman, "Lifetimes of the negative molecular hydrogen ions: $H_2^-$, $D_2^-$, and $HD^-$," Physical Review A, vol. 73, p. 060501, 2006.

[32] B. M. Schwarzschild, "Negative ions of molecular hydrogen," Physics Today, vol. 64, p. 23, 2011.

[33] H. Eyring, J. O. Hirschfelder, and H. S. Taylor, "The Theoretical Treatment of Chemical Reactions Produced by Ionization Processes Part I. The Ortho-Para Hydrogen Conversion by Alpha-Particles," The Journal of Chemical Physics, vol. 4, pp. 479-491, 1936.

[34] B. L. Moiseiwitsch, "Electron Affinities of Atoms and Molecules," in Advances in Atomic and Molecular Physics. vol. 1, D. R. Bates and I. Estermann, Eds., ed New York: Academic Press, 1965, pp. 61-83.

[35] I. Fischer-Hjalmars, "Theoretical Investigation of the Negative Hydrogen Molecule Ion," The Journal of Chemical Physics, vol. 30, p. 1099, 1959.

[36] R. D. Harcourt, "A bound 2 Σg+ ground state for $H_2^-$. A valence-bond study," Journal of Physics B: Atomic and Molecular Physics, vol. 20, p. L617, 1987.

[37] A. Dalgarno and M. R. C. McDowell, "Charge Transfer and the Mobility of H−Ions in Atomic Hydrogen," Proceedings of the Physical Society. Section A, vol. 69, p. 615, 1956.

[38] B. Jordon-Thaden, H. Kreckel, R. Golser, D. Schwalm, M. H. Berg, H. Buhr, H. Gnaser, M. Grieser, O. Heber, M. Lange, O. Novotný, S. Novotny, H. B. Pedersen, A. Petrignani, R. Repnow, H. Rubinstein, D. Shafir, A. Wolf, and D. Zajf man, "Structure and Stability of the Negative Hydrogen Molecular Ion," Physical Review Letters, vol. 107, p. 193003, 2011.

[39] V. I. Khvostenko and V. M. Dukel'skii, "Formation of negative H− ions in electron collisions with hydrogen molecules," Zhurnal Eksperimental'noi i Teoreticheskoi Fiziki, vol. 33, p. 5, 1957.

[40] R. Golser, H. Gnaser, W. Kutschera, A. Priller, P. Steier, A. Wollner, M. Čižek, J. Horáček, and W. Domcke, "Experimental and Theoretical Evidence for Long-Lived Molecular Hydrogen Anions H_{2}^{−} and D_{2}^{−}," Physical Review Letters, vol. 94, p. 223003, 2005.

[41] A. A. Shiryaev, D. Grambole, A. Rivera, and F. Herrmann, "On the interaction of molecular hydrogen with diamonds: An experimental study using nuclear probes and thermal desorption," Diamond and Related Materials, vol. 16, pp. 1479-1485, 2007.

[42] M. S. Melnik, "Diamond Surfaces: Interactions with Hydrogen and Halogens," Doctor of Philosophy PDF, Applied Physics, California Institute of Technology, Pasadena, Calif., 1997.

[43] R. Roberts, "Energy Sources and Conversion Techniques: What is our capability of meeting the energy needs of the future within the limitations of known energy resources and energy conversion technology," American Scientist, vol. 61, pp. 66-75, 1973.

What is claimed is:

1. A thermionic energy conversion system comprising:

a containment vessel;

an electrically and thermally conductive anode positioned inside the containment vessel;

a cathode comprising substantially diamond and having a non-electron emitting surface and an electron emitting surface, at least a portion of the electron emitting surface positioned inside the containment vessel and separated from the anode by a gap;

a hydrogen source positioned outside the containment vessel and configured to supply hydrogen to the non-electron emitting surface of the cathode whereby hydrogen can be caused to diffuse through the cathode to the electron emitting surface during electron emission;

the gap is configured to sustain a vacuum whereby when hydrogen is supplied by the hydrogen source, an average partial pressure of hydrogen at the non-electron emitting surface of the cathode is greater than an average partial pressure of hydrogen at the electron emitting surface of the cathode, and whereby electrons emitted from the electron emitting surface of the cathode can cross the gap for collection by the anode;

a heat source thermally coupled to the cathode; and an electric circuit comprising an electrical load, the electric circuit coupled to the anode and cathode so that electrons emitted from the cathode and collected at the anode can be supplied to the electrical load.

2. The system of claim 1, the cathode comprising at least one of single-crystal diamond, a CVD polycrystalline diamond film, diamond-like carbon, and a material of more than 90% carbon bound by sp3 chemical bonding.

3. The system of claim 2 wherein the cathode comprises a cathode membrane having a cathode membrane thickness that is less than 200 micrometers and wherein the electron emitting surface is substantially positioned inside the containment vessel and the non-electron emitting surface is positioned outside the containment vessel.

4. The system of claim 3 wherein the cathode membrane thickness is less than 20 micrometers.

5. The system of claim 4 wherein the cathode membrane thickness is less than 1 micrometer.

6. The system of claim 1 further comprising a vacuum system having a vacuum pump coupled to the gap.

7. The system of claim 6 wherein the vacuum system is coupled to the vacuum source so that hydrogen that is diffused through the cathode can be collected from the gap and recycled.

8. The system of claim 1 wherein the cathode has at least one surface attached to a substrate through which hydrogen can flow.

9. The system of claim 8 wherein the substrate is perforated.

10. A method for direct conversion of heat to electricity using a thermionic electric conversion system, the method comprising:

providing a cathode inside a containment vessel, the cathode comprising substantially diamond and having an electron-emitting surface and a non-electron emitting surface;

providing an electrically conductive anode inside the containment vessel, the anode separated from the electron-emitting surface of the cathode by a gap;

electrically coupling the anode and cathode to an electric circuit outside the containment vessel, the electric circuit comprising an electrical load;

creating a vacuum inside the gap sufficient to enable a free flow of electrons from the cathode to the anode across the gap;

heating the cathode to a temperature sufficient to cause electrons to be emitted from the electron-emitting surface and to flow across the gap to the anode;

during electron emission from the cathode, diffusing hydrogen through the cathode from the non-electron emitting surface to the electron-emitting surface to enhance emission of electrons from the cathode;

collecting at the anode the electrons emitted from the cathode; and coupling the electrons collected at the anode to the electrical load via the electric circuit.

11. The method of claim 10 wherein hydrogen is continuously diffused through the cathode during electron emission.

12. The method of claim 10 wherein hydrogen is intermittently diffused through the cathode during electron emission.

13. The method of claim 12 further comprising collecting and recycling at least some of the hydrogen that is diffused through the cathode.

14. The method of claim 10 wherein hydrogen is diffused through the cathode by maintaining an average partial pressure of hydrogen at the non-electron emitting surface of the cathode that is greater than an average partial pressure of hydrogen at the electron emitting surface of the cathode.

* * * * *